US012188695B2

(12) United States Patent
Trevisan

(10) Patent No.: US 12,188,695 B2
(45) Date of Patent: Jan. 7, 2025

(54) AIR-COOLED REFRIGERATION CYCLE ARRANGEMENT

(71) Applicant: MITSUBISHI ELECTRIC HYDRONICS & IT COOLING SYSTEMS S.P.A., Bassano del Grappa (IT)

(72) Inventor: Marco Trevisan, Bassano del Grappa (IT)

(73) Assignee: MITSUBISHI ELECTRIC HYDRONICS & IT COOLING SYSTEMS S.P.A., Bassano dei Grappa (IT)

( * ) Notice: Subject to any disclaimer, the term of this patent is extended or adjusted under 35 U.S.C. 154(b) by 240 days.

(21) Appl. No.: 17/775,671

(22) PCT Filed: Nov. 18, 2020

(86) PCT No.: PCT/IB2020/060856
§ 371 (c)(1),
(2) Date: May 10, 2022

(87) PCT Pub. No.: WO2021/099955
PCT Pub. Date: May 27, 2021

(65) Prior Publication Data

US 2022/0404072 A1 Dec. 22, 2022

(30) Foreign Application Priority Data

Nov. 18, 2019 (IT) ..... 102019000021486

(51) Int. Cl.
*F25B 40/02* (2006.01)
*F25B 39/00* (2006.01)
(Continued)

(52) U.S. Cl.
CPC ..... *F25B 40/02* (2013.01); *F25B 39/00* (2013.01); *F25B 40/04* (2013.01); *F25B 43/043* (2013.01);
(Continued)

(58) Field of Classification Search
CPC .. F25B 40/02; F25B 40/04; F25B 6/04; F25B 39/00; F25B 43/043; F25B 2400/05;
(Continued)

(56) References Cited

U.S. PATENT DOCUMENTS 5,979,172 A * 11/1999 Teller ..... F25B 40/02 62/277
2009/0223231 A1* 9/2009 Snow, III ..... F24F 1/50 165/181

(Continued)

FOREIGN PATENT DOCUMENTS

CN 1779384 5/2006
CN 203605511 5/2014

(Continued)

OTHER PUBLICATIONS

English language translation of Chinese Office Action dated Jun. 19, 2023, in connection with Application No. 2020800793685, Applicant, Mitsubishi Electric Hydronics & IT Cooling Systems S.P.A. (8 pages).

(Continued)

*Primary Examiner* — Joseph F Trpisovsky
(74) *Attorney, Agent, or Firm* — KLINTWORTH & ROZENBLAT IP LLP

(57) ABSTRACT

Air-cooled module for an air-cooled refrigeration cycle apparatus, comprising a desuperheater and condenser heat exchanger configured for being fluidly connected to a compressor of the air-cooled refrigeration cycle apparatus and a subcooler configured for being fluidly connected to an
(Continued)

expansion member of the air-cooled refrigeration cycle apparatus, both the desuperheater and condenser heat exchanger and the subcooler being configured to allow the passage of a refrigerant fluid inside themselves for cooling the refrigerant fluid thanks to an air flow directed to pass through these latter, the subcooler being fluidically in series downstream and physically separated with respect to the desuperheater and condenser heat exchanger, these latter elements being positioned relatively so the air flow passes before in the subcooler and then in the desuperheater and condenser heat exchanger.

20 Claims, 5 Drawing Sheets

(51) Int. Cl.
*F25B 40/04* (2006.01)
*F25B 43/04* (2006.01)

(52) U.S. Cl.
CPC ..... *F25B 2400/05* (2013.01); *F25B 2400/13* (2013.01); *F25B 2400/21* (2013.01); *F25B 2500/09* (2013.01)

(58) Field of Classification Search
CPC ..... F25B 2400/13; F25B 2400/21; F25B 2500/09; F25B 1/50; F25B 1/48; F28D 1/0443; F28D 2001/0266; F28F 2215/04
See application file for complete search history.

(56) References Cited

U.S. PATENT DOCUMENTS

| | | | | |
|---|---|---|---|---|
| 2010/0242532 | A1 | 9/2010 | Kopko et al. | |
| 2011/0192188 | A1 | 8/2011 | Nickey et al. | |
| 2018/0142926 | A1* | 5/2018 | Baker | F25B 9/002 |
| 2018/0313587 | A1* | 11/2018 | Du | F25B 6/04 |

FOREIGN PATENT DOCUMENTS

| | | |
|---|---|---|
| CN | 105466091 | 4/2016 |
| EP | 2535671 | 12/2012 |
| EP | 3364129 | 8/2018 |

OTHER PUBLICATIONS

International Search Report and Written Opinion of the International Searching Authority, dated Feb. 22, 2021, in connection with International Application No. PCT/IB2020/060856 (13 pages).

* cited by examiner

AIR-COOLED REFRIGERATION CYCLE ARRANGEMENT

CROSS-REFERENCE TO RELATED APPLICATIONS

This patent application claims priority from Italian patent application no. 102019000021486 filed on 18 Nov. 2019, the entire disclosure of which is incorporated herein by reference.

TECHNICAL FIELD

The present invention concerns an air-cooled refrigeration cycle arrangement, in particular for air conditioning, food storage, process cooling machines and other machines intended for managing media temperature and/or humidity.

BACKGROUND OF THE INVENTION

Air-cooled refrigeration cycle arrangements are widely known and used for managing media temperature and/or humidity into a closed space. However, such arrangements are known to have a high energetic consumption.

Such high energetic consumption is a crucial parameter, especially for large plants such as industrial or commercial spaces which need to conditioning great flows of air or large process cooling installations.

Examples of known refrigeration arrangements are disclosed in US201024532 A1, EP2535671 A2, US2011192188 A1 and EP3364129 A1.

Therefore, the need is felt to improve the efficiency of known air-cooled refrigeration cycle arrangements so that their energetic consumption is reduced.

An aim of the present invention is to satisfy the above mentioned needs in a cost effective and optimized way.

SUMMARY OF THE INVENTION

The aforementioned aim is reached by an air-cooled refrigeration cycle arrangement as claimed in the appended set of claims.

BRIEF DESCRIPTION OF DRAWINGS

For a better understanding of the present invention, a preferred embodiment is described in the following, by way of a non-limiting example, with reference to the attached drawings wherein.

DETAILED DESCRIPTION OF THE INVENTION

Figure 1:
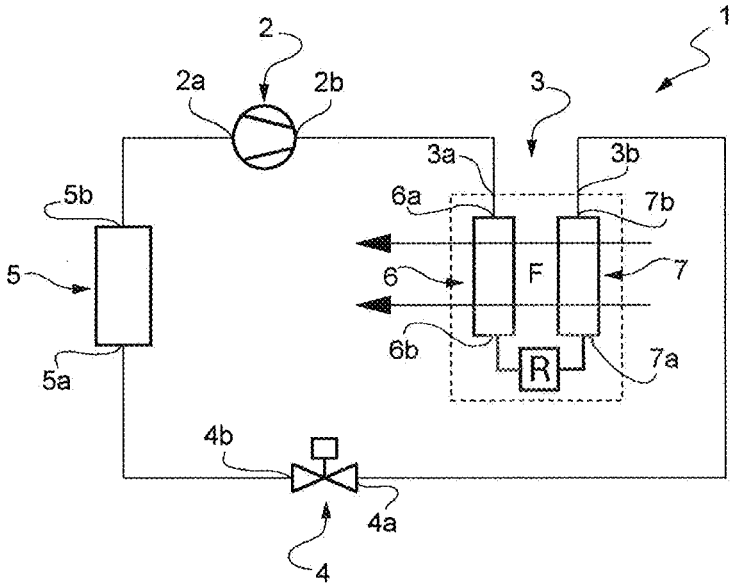
FIG. 1 is a schematic functional representation of an air-cooled refrigeration cycle arrangement according to a first embodiment of the present invention.

The air-cooled refrigeration cycle arrangement according to the present invention is schematically shown in FIG. 1 and indicated, globally, with reference number 1.

Air-cooled refrigeration cycle arrangement 1 comprises a compressor means 2 configured to move a refrigerant fluid between an input 2*a* and an output 2*b* of these latter and increase its pressure of.

Air-cooled refrigeration cycle arrangement 1 then comprises a air-cooled module 3 fluidly connected in series to compressor means 2 and configured to desuperheat, condense and subcool the refrigerant fluid between an input 3*a* and an output 3*b* of this latter, thereby exchanging thermal energy with the ambient air, in particular providing heat to this latter.

Air-cooled refrigeration cycle arrangement 1 further comprises expansion means 4, fluidly connected in series to air-cooled module 3 and configured to decrease the pressure of the fluid between an input 4*a* and an output 4*b* of this latter.

Then, air-cooled refrigeration cycle arrangement 1 further comprises evaporation means 5, fluidly connected in series to expansion means 4 and configured to evaporate and superheat the temperature of the refrigerant fluid, thereby exchanging thermal energy with the media (air or water or other media), in particular absorbing heat from this latter.

According to an aspect of the invention, the air-cooled module 3 comprises, fluidically in series but physically separated one with respect to the other, a desuperheater and condenser heat exchanger, in the following for sake of brevity called "condenser" 6 and a subcooler heat exchanger 7, in the following, for sake of brevity called "subcooler".

In particular, the condenser 6 comprises an inlet 6*a* fluidly connected to the output 2*b* of compressor means 2 and an output 6*b* fluidly connected to an input 7*a* of the subcooler 7. This latter comprises an output 7*b* fluidly connected to inlet 4*a* of expansion means 4. According to a further aspect of the invention, an air flow F is configured to pass through the air-cooled module 3, in particular passing first through the subcooler 7 and then through the condenser 6. Accordingly, the subcooler 7 exchanges heat with the ambient air with the fluid already desuperheated and condensed by condenser 6, this latter exchanges heat with the air heated by subcooler 7 and the superheated fluid coming from compressor means 2. Optionally, the air-cooled refrigeration cycle arrangement 1 may further comprise a liquid reservoir R fluidly interposed between condenser 6 and subcooler 7 in order to guarantee that a flow of saturated refrigerant liquid reaches the subcooler 7 whatever are the refrigeration cycle working conditions.

Figure 2:
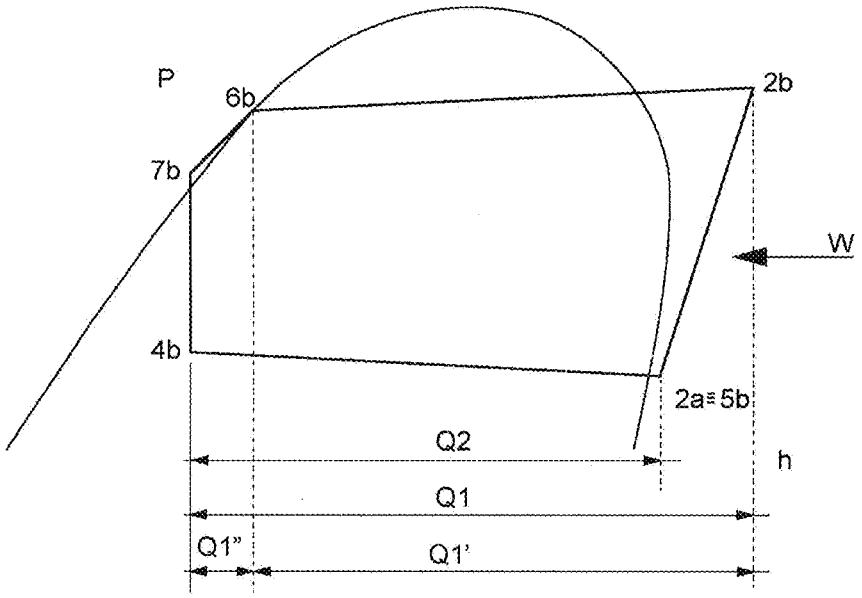
FIG. 2 is a p/h diagram showing the thermodynamic refrigerating cycle of the air-cooled refrigeration cycle arrangement of FIG. 1.

As can be seen in thermodynamic diagrams of FIGS. 2 and 3, then the refrigerant fluid follows the below listed transformations in the described air-cooled refrigeration cycle arrangement 1:

- A compression between points 2*a*=5*b* and 2*b* thanks to compressor means wherein the gaseous refrigerant fluid passes to higher pressure superheated state thanks to work W provided by compression means 2;
- A constant pressure (except for pressure losses) heat exchange between points 2*b* and 6*b* thanks to condenser 6, wherein the refrigerant fluid passes to superheated vapor to saturated liquid providing heat $Q_1'$ to the ambient air;

A further heat exchange between points 6*b* and points 7*b* thanks to subcooler 7 wherein the condensed fluid continues to decrease its temperature providing heat $Q_1''$ to the ambient air; and An isenthalpic expansion between points 7*b* and 4*b* wherein the condensed fluid decreases its pressure till reaching a present temperature; and A constant temperature heat exchange (except for the pressure losses) between points 4*b* and point 2*a* wherein the fluid evaporates and superheat passing to vapor phase, thereby extracting heat $Q_2$ from the media.

According to the above, it is clear that the further phase of cooling in air-cooled module 3 thanks to subcooler 7 reduces the waste of exergy in the arrangement 1.

Figure 3:
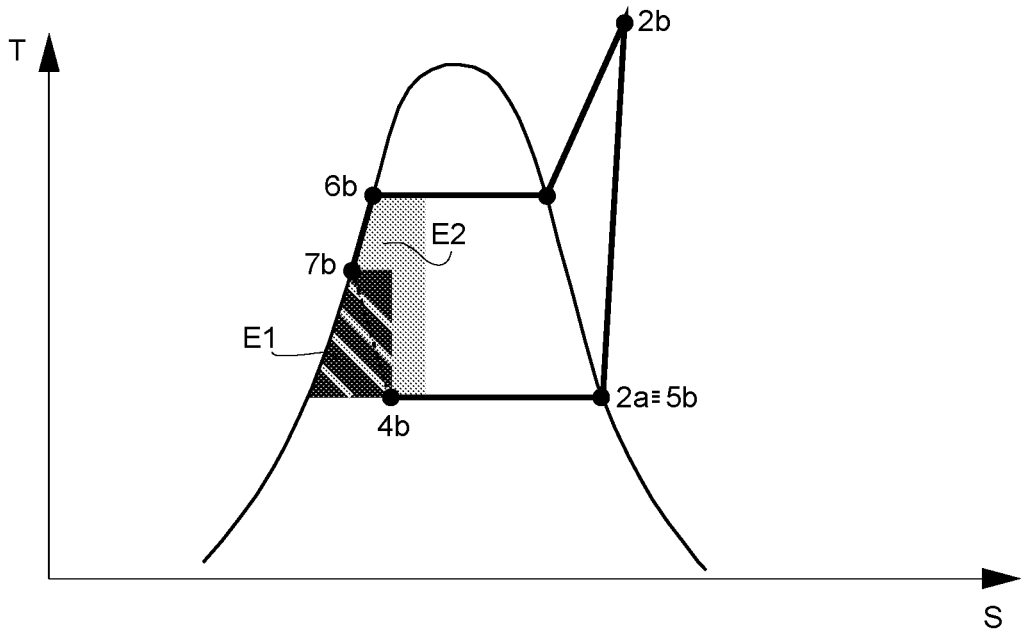
FIG. 3 is a T-s diagram showing the thermodynamic refrigerating cycle of the air-cooled refrigeration cycle arrangement of FIG. 1 and of FIG. 6.

Indeed, as can be seen in FIG. 3, the area $E_1$ represents the exergy lost during the isenthalpic expansion of the refrigerant fluid, while the area $E_2$ represents the exergy lost if the isenthalpic expansion would have started, as usual, from the outlet 6*b* of the heat exchanger. Accordingly, the exergetic balance of the refrigerant cycle is greater since the exergy lost is decreased.

Figure 4:
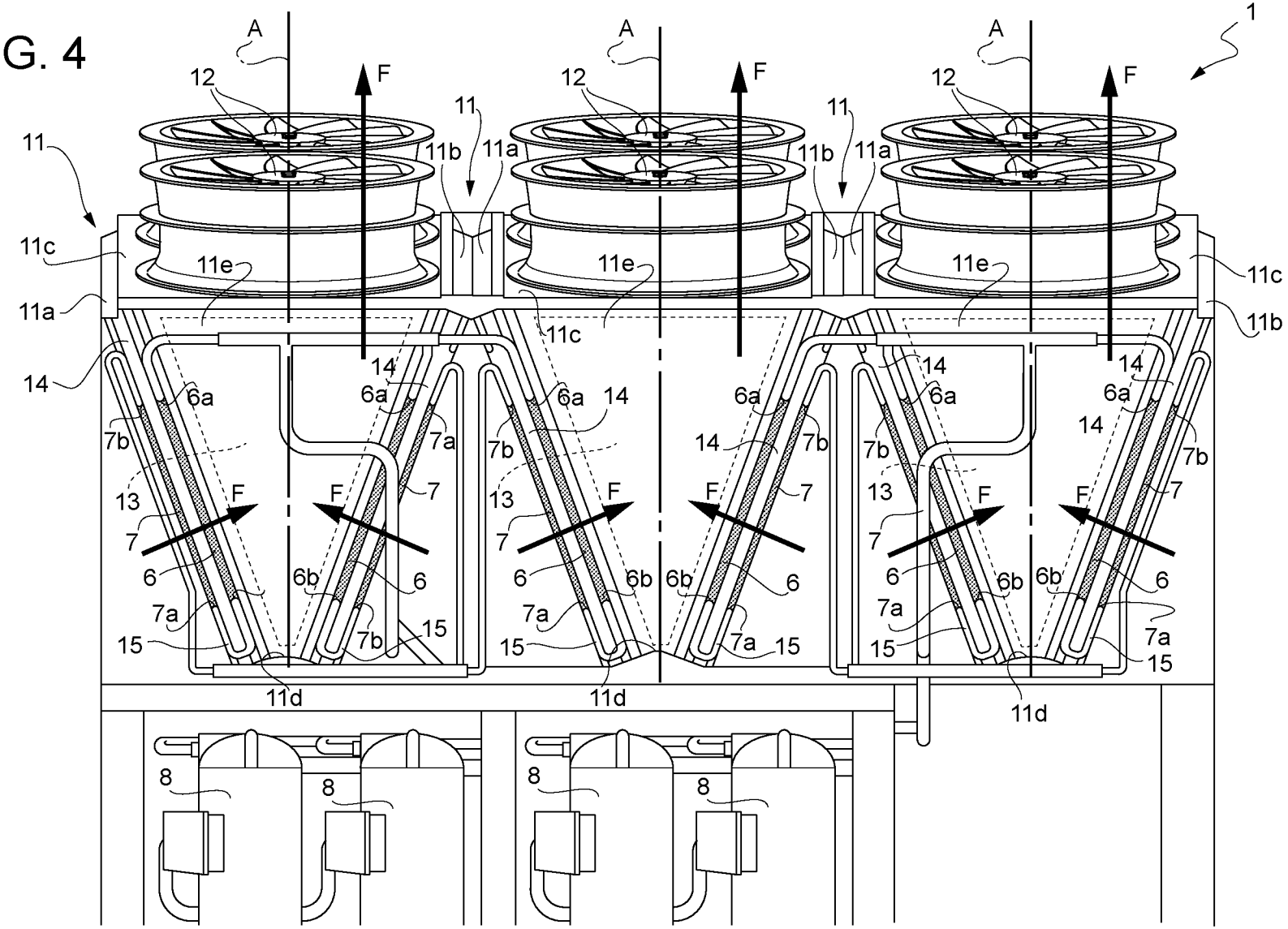
FIG. 4 is a lateral schematic view of an air-cooled refrigeration cycle apparatus according to the first embodiment of the present invention.
Figure 5:
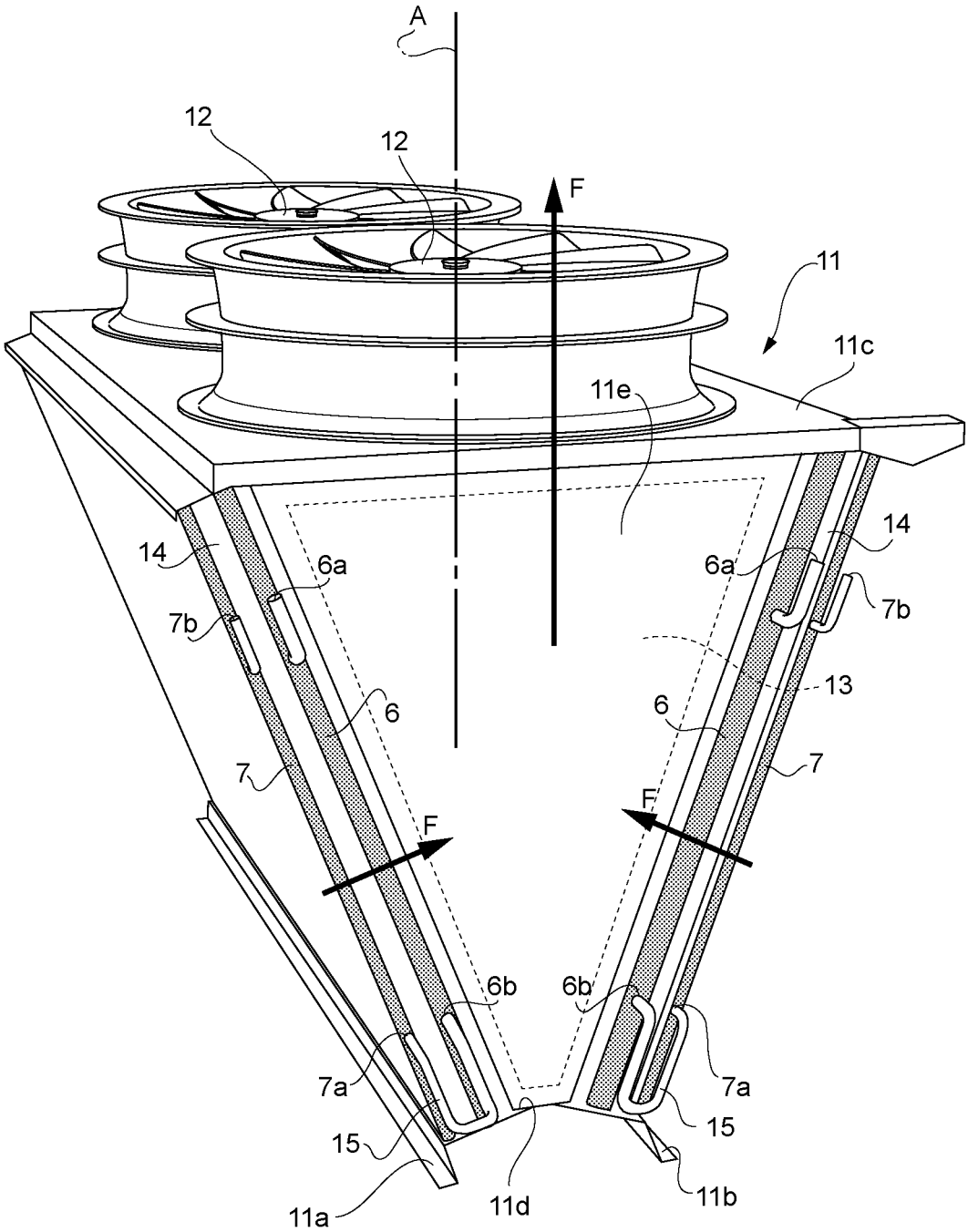
FIG. 5 is a perspective view of a portion of the embodiment of FIG. 4.

An advantageous physical embodiment of the above described arrangement 1 is partially shown in FIGS. 4 and 5.

Indeed, FIGS. 4 and 5 shown a source of refrigerant fluid in pressure, e.g. defined by a plurality of compressors 8, fluidly connected to the air-cooled module 3. In particular, the disclosed embodiment 1 comprises a plurality of air-cooled modules 3, each carried by an aerator 11, e.g. a V-shaped aerator 11 of known typology.

Accordingly, but not limited, each aerator 11 comprises a left lateral plate 11*a* and a right lateral plate 11*b* converging to a common symmetry axis A. On the top, each aerator 11 comprises a top plate 11*c* provided with ventilation means 12, e.g. an electric actuated fan. On the bottom the aerator 11 is closed by a bottom plate 11*d* while transversally each aerator 11 is closed by respective front and rear plates 11*e*.

Accordingly, ventilation means 12 can suck air from a closed space 13 laterally delimited by lateral plates 11*a*, 11*b* and transversal plates 11*e* and axially delimited by top and bottom plates 11*c*, 11*d*.

Preferably, air-cooled module 3 is housed in lateral plates 11*a*, 11*b* and preferably extends on the majority of the area delimited by this latter, which are voted to allow the fixation of air-cooled module 3. In other words, plates 11*a*, 11*b* defines an opening (not shown) extending on the majority of the area of plates 11*a*, 11*b* and allowing the housing of air-cooled module 3.

In particular, both the condenser 6 and the subcooler 7 may be realized as plate-like exchangers through which air flow F may pass and according to an aspect of the invention, they are carried one faced with respect to the other and separated by a space 14. In greater particular, the condenser 6 has a side facing space 13 and the opposite side facing space 14 to avoid any thermal contact in between while the subcooler 7 has a side facing the environment and the opposite side facing the condenser 6.

Accordingly, an air flow F is sucked by ventilation means 12 through the air-cooled module 3, i.e. through both the condenser 6 and the subcooler 7. Therefore, a pair of flows F is sucked through the air-cooled module 3 and such flows F are ejected through ventilation means 12 into the environment through the top place 11*c*.

As can be further see in greater detail in FIG. 5, according to a further aspect of the invention, in case it has more than one pass, the refrigerant fluid enters into condenser 6 from the edge nearer with respect to top plate, i.e. at an upper portion of the condenser 6 along the vertical axis A and then, exit from condenser 6 from the edge nearer with respect to the bottom opening, i.e. at a lower portion of the condenser 6 along the vertical axis A.

Then, the exit of condenser 6 is fluidly connected by a joint conduit 15 to subcooler 7 into which, in case it has more than one pass, the fluid enters from an edge nearer with respect to bottom plate, i.e. at a lower portion of the subcooler 7 along the vertical axis A and exit from subcooler 7 from an edge nearer with respect to the top plate, i.e. at an upper portion of the subcooler 7 along the vertical axis A.

Therefore, in such configuration the condenser 6 and the subcooler 7 are fluidically placed one with respect to the other in a counterflow configuration; indeed, in inlet 6*a* of condenser 6 flows the most heated fluid while in outlet 7*b* of subcooler 7, placed at substantially the same height, flows the saturated fluid at its lowest temperature and vice versa, in the joint conduit 15 flows a saturated fluid at an intermediate temperature.

According to a further aspect of the invention, the subcooler 7 is provided with a lower density of fins with respect to the condenser 6.

In particular, the subcooler 7 may comprise a 0 FPI (fins per inch) till 15 FPI, while the condenser may comprise a density higher than 20 FPI. It is furthermore stressed that, if both the condenser 6 and the subcooler 7 comprise fins, they are always spaced, i.e. fins of these latter do not touch one with the other.

According to another aspect of the invention, the exchanger defining subcooler 7 comprises tubes having a cross section lower with respect to the tubes comprised by the condenser. In particular, subcooler 7 comprises very small cross section channels (not shown), for sake of example multiport flat pipes 12 mm×1.5 mm. Such very small cross section channels provides a high speed of the liquid refrigerant and therefore a high pressure drop, even more than 2 bars.

The operation of the above disclosed proposed physical embodiment of the air-cooled refrigeration cycle arrangement 1 is the following.

The compressed and superheated gas coming from compressor means 2 is sent thanks to the related conduits to opening 6*a* of condenser 6; the temperature of the fluid is about 50-80K above the ambient temperature. Here, the air flow F starts to cool the fluid till it reaches a temperature at the output of about 15K above the ambient temperature. It has to be noticed that the flow which cools the refrigerant fluid in the condenser 6 has been already partially heated, because it comes from the subcooler 7, as stated below. Then the refrigerant flows into subcooler 7 reducing its temperature very closed to the ambient one (less than 1K above the ambient temperature) exchanging heat with air at ambient temperature only and all the air moved by the fans at ambient temperature.

It has to be noticed that the refrigerant pressure drop has to be avoided in the known air cooled condensers because of the consequent refrigerant temperature reduction and therefore thermal exchange efficiency loss. The liquid refrigerant pressure drop along the subcooler 7, that can be seen in transformation in FIG. 2 from 6*b* to 7*b* of the P-h diagram, since the liquid refrigerant is reducing its pressure remaining in the liquid state, does not create any temperature variation and therefore any air-refrigerant temperature approach reduction allowing a subcooler 7 design that take advantage of high refrigerant pressure drops increasing the heat transfer coefficient.

Figure 6:
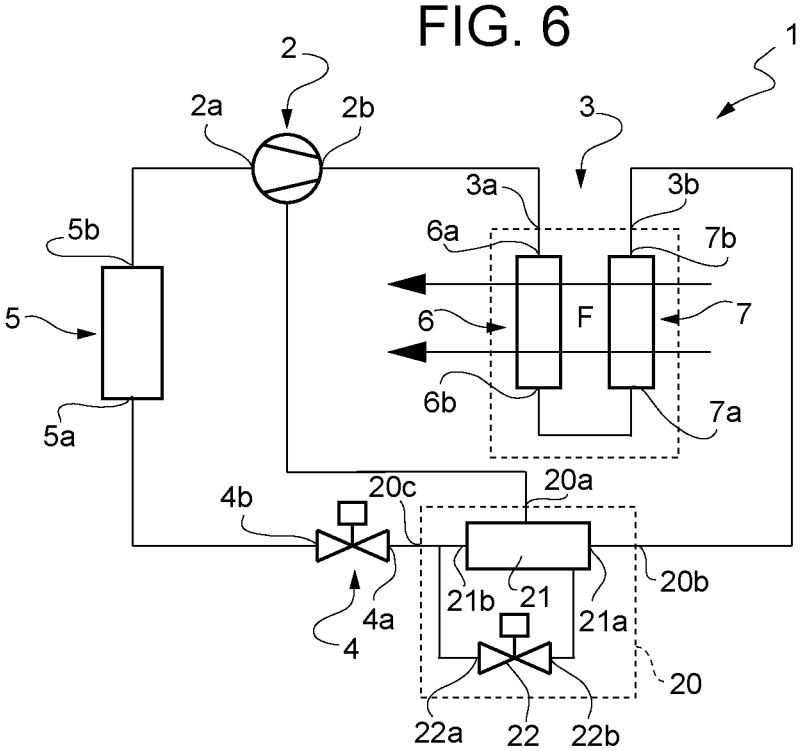
FIG. 6 is a schematic functional representation of an air-cooled refrigeration cycle arrangement according to a second embodiment of the present invention.
Figure 7:
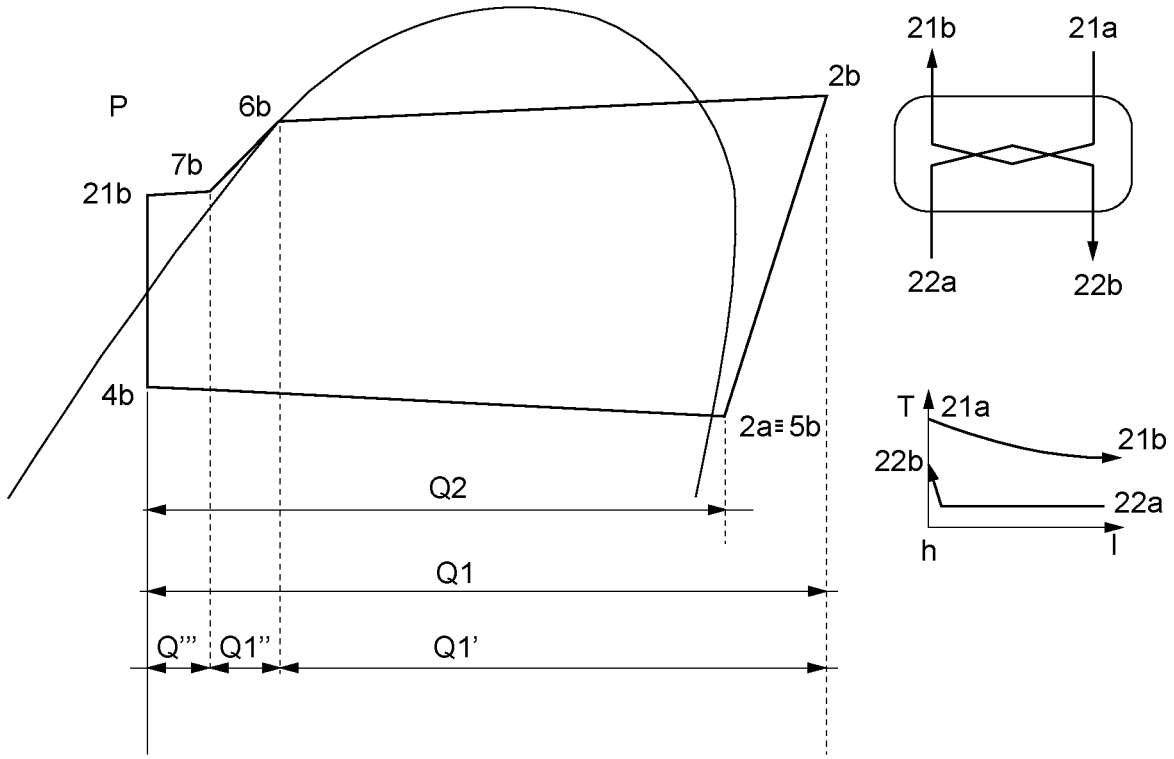
FIG. 7 is a p/h diagram showing the thermodynamic refrigerating cycle of the air-cooled refrigeration cycle arrangement of FIG. 6.

FIGS. 6, 7 disclose a further embodiment of the air-cooled refrigeration cycle apparatus 1 which differs from the first embodiment by the fact of comprising an economizer 20 fluidly interposed in parallel with respect to air-cooled module 3.

In particular, a first opening 20*a* of economizer 20 is fluidly connected to compressor means 2, a second opening 20*b* is fluidly connected to air-cooled module outlet 3*b* and output third opening 20*c* of economizer 20 is fluidly connected to expansion means 4.

In greater detail the economizer 20 comprises a heat exchanger 21 comprising an inlet 21*a* fluidly connected to the subcooler 7 and an outlet 21*b* fluidly connected to expansion means 4 and expansion means 22 fluidly in parallel to heat exchanger 21. Accordingly, expansion means 22 comprises an inlet 22*a* fluidly connected downstream to heat exchanger 21 and upstream to expansion means 4 and an outlet 22*b* fluidly connected upstream to the heat exchanger 21.

In particular, as known and represented in FIGS. 6 and 7, expansion means 22 can be controlled to manage the downstream to heat exchanger 21 and expanded so as to provide a further cooling to the refrigerant fluid flowing between inlet and outlet 21*a*, 21*b* of heat exchanger 21. Then, such spilled flow will join the remaining portion of the refrigerant fluid flow into compression means 2.

In particular, heat exchanger 21 is a liquid counterflow heat exchanger, as schematized in FIG. 7. Always in such figure, it can be seen that the addition of the economizer allows a further cooling Q1''' of the liquid at constant pressure (except for pressure losses) before the isenthalpic expansion in expansions means 4. Accordingly, the efficiency of the system is further increased since the heat Q1 provided to the environment increases.

In view of the foregoing, the advantages of the proposed air-cooled refrigeration cycle arrangement 1 according to the invention are apparent.

The fact that the subcooler 7 is separated and fluidically in series downstream to the condenser 6 and that the air ambient temperature flow F passes first from subcooler 7 and then to condenser 6 reduces the temperature differences at which the subcooler 7 and the condenser 6 works, thereby improving the percentage of recovered energy, i.e. reducing the exergetic drop of the system.

Accordingly, without reducing the work provided to compressor means 2, the efficiency of the system is greatly improved. In particular the thermodynamic efficiency is improved by values around 8-12% depending on the refrigerant properties and refrigeration cycle working conditions, nevertheless with or without the economizer. The cooling capacity is improved by 8-12% without economizer, 14-16% with economizer, again depending on refrigerant and conditions.

Accordingly, for arrangements that has to be used for small operations, the economizer may be removed and therefore costs, complexity and encumbrances are reduced. Conversely, for arrangements that has to be used for great operations, the economizer further adds efficiency thereby further increasing the efficiency of the arrangement.

Increasing the system means obviously reducing power consumption and thereby reducing costs for the user.

The fact that the condenser 6 and the subcooler 7 are separated improves the thermal exchange efficiency of the two heat exchangers, avoiding the creation of thermal bridges in contact points as in known systems.

Due to the low thermal approach the subcooler 7 can work without using fins, or using very small fins, thereby reducing manufacturing costs and encumbrance of the system and with negligible pressure drops on air side that would require additional fans.

The high refrigerant pressure drops provide a good thermal exchange without risk to flashing (i.e. there will be not flash vapor generated during the pressure reduction process thanks to the subcooling).

In case of the subcooler 7 has more than one pass, the peculiar disposition of the V-Shaped aerator allows the refrigerant at the lowest temperature to be in contact with the maximum air flow F, since this latter is maximum closed to the fans.

It is clear that modifications can be made to the described air arrangement apparatus 1 which do not extend beyond the scope of protection defined by the claims.

For example, it's evident that the air-cooled refrigeration cycle apparatus 1 may comprise different and further elements with respect to the claimed one.

It's furthermore clear that the evaporator 5 may be of any typology, such as the condenser 6 or the subcooler 7, according to the features claimed hereinafter.

Moreover, compression means 2 and fans 12 may comprise any typology of compressor as known in the art such as expansion means 4 may comprise any nozzle or valve as known and fans 12 may comprise any typology of fan.

Again, the shown topology of conduits and the physical embodiment described herein are merely exemplarily and it's clear that the proposed shapes and elements may be varied in their shape and number.

Finally, it is obvious that the arrangement can be applied to any kind of refrigerant molecule, currently existing or of future production.

The invention claimed is:

1. Air-cooled module for an air-cooled refrigeration cycle apparatus, said air-cooled module comprising a desuperheater and condenser heat exchanger configured for being fluidly connected to compressor means of said air-cooled refrigeration cycle apparatus and a subcooler configured for being fluidly connected to expansion means of said air-cooled refrigeration cycle apparatus, characterized in that both said desuperheater and condenser heat exchanger and said subcooler being configured to allow the passage of a refrigerant fluid inside themselves for cooling said refrigerant fluid thanks to an air flow directed to pass through these latter, wherein said subcooler is fluidically in series downstream of said desuperheater and condenser heat exchanger with respect to passage of said refrigerant fluid and wherein said subcooler is spaced with respect to said desuperheater and condenser heat exchanger thereby avoiding a direct thermal contact between these latter, said desuperheater and condenser heat exchanger and said subcooler being positioned relatively so the said air flow passes before in said subcooler and then in said desuperheater and condenser heat exchanger; and an aerator comprising a structure configured to define a top plate, a bottom plate and at least two lateral plates connected to such top and bottom plates and opposite one with respect to the other about a vertical axis, the lateral plates being configured to define a space which is laterally delimited by said at least two lateral plates and axially delimited along said vertical axis by said top and bottom plates, wherein said space is configured to house the air-cooled module and wherein said top plate is configured to carry ventilation means configured to suck air from said space and flow this latter towards the environment.

2. Air-cooled module according to claim 1, wherein said subcooler is a heat exchanger which is not provided with fins.

3. Air-cooled module according to claim 1, wherein said subcooler is a heat exchanger which is provided with fins having a lower density than said desuperheater and condenser heat exchanger.

4. Air-cooled module according to claim 1, wherein said subcooler is provided with tubes having a cross section lower with respect to tubes of which said desuperheater and condenser heat exchanger is provided.

5. Air-cooled module according to claim 1, wherein said subcooler is a heat exchanger provided with tubes having a cross-section lower than 2.5 mm.

6. Air-cooled module according to claim 1, comprising a liquid reservoir fluidly interposed between said desuperheater and condenser heat exchanger and said subcooler.

7. Air-cooled module according to claim 1, wherein said desuperheater and condenser heat exchanger and said subcooler are physically separated one with respect to the other.

8. Air-cooled refrigeration cycle apparatus comprising a compressor means configured to increase the pressure of a refrigerant fluid between an inlet and an outlet of said compressor means, expansion means configured to decrease the pressure of said refrigerant fluid between an inlet and an outlet of said expansion means and an evaporator configured to allow the passage of phase from liquid to gaseous state of said refrigerant fluid between an inlet and an outlet of said evaporator, said air-cooled refrigeration cycle apparatus comprising an air-cooled module according to claim 1 fluidly interposed in series between said compressor means and said expansion means.

9. Air-cooled refrigeration cycle apparatus according to claim 8, further comprising an economizer fluidly interposed in parallel to said air-cooled module between said compressor means and said expansion means.

10. Air-cooled module for an air-cooled refrigeration cycle apparatus, said air-cooled module comprising a desuperheater and condenser heat exchanger configured for being fluidly connected to compressor means of said air-cooled refrigeration cycle apparatus and a subcooler configured for being fluidly connected to expansion means of said air-cooled refrigeration cycle apparatus, characterized in that both said desuperheater and condenser heat exchanger and said subcooler being configured to allow the passage of a refrigerant fluid inside themselves for cooling said refrigerant fluid thanks to an air flow directed to pass through these latter, wherein said subcooler is fluidically in series downstream of said desuperheater and condenser heat exchanger with respect to passage of said refrigerant fluid and wherein said subcooler is spaced with respect to said desuperheater and condenser heat exchanger thereby avoiding a direct thermal contact between these latter, said desuperheater and condenser heat exchanger and said subcooler being positioned relatively so the said air flow passes before in said subcooler and then in said desuperheater and condenser heat exchanger; and an aerator comprising a top plate, a bottom plate and at least two lateral plates connected to such top and bottom plates and opposite one with respect to the other about a vertical axis, the lateral plates defining a space which is laterally delimited by said at least two lateral plates and axially delimited along said vertical axis by said top and bottom plates, wherein said space houses the air-cooled module and wherein said top plate carries a fan configured to direct air from said space and flow this latter towards the environment.

11. The air-cooled module according to claim 10, wherein said aerator comprises two of said lateral plates and two transversal plates thereby defining a V-shape into which said two of said lateral plates are converging in a lower side with respect to said vertical axis.

12. The air-cooled module according to claim 10, wherein said desuperheater and condenser heat exchanger of said air-cooled module is carried by a respective one of said two of said lateral plates so as to be faced towards said space from one side and to said subcooler from an opposite side, and wherein said subcooler of said air-cooled module is carried by the respective one of said two of said lateral plates so as to be faced towards the environment from the one side and to said desuperheater and condenser heat exchanger from the opposite side, said desuperheater and condenser heat exchanger and said subcooler being separated by a space.

13. The air-cooled module according to claim 12, wherein an inlet of said desuperheater and condenser heat exchanger and an outlet of said subcooler are placed on an upper portion of respectively said desuperheater and condenser heat exchanger and said subcooler according to said vertical axis and wherein an outlet of said desuperheater and condenser heat exchanger and an inlet of said subcooler are placed on a lower portion of respectively said desuperheater and condenser heat exchanger and said subcooler according to said vertical axis-said outlet of said desuperheater and condenser heat exchanger and said inlet of said subcooler being connected by a conduit spaced with respect to both desuperheater and condenser heat exchanger and subcooler.

14. The air-cooled module according to claim 13, wherein the inlet of said desuperheater and condenser heat exchanger and the outlet of said subcooler are placed at substantially the same height with respect to an axis and wherein the outlet of said desuperheater and condenser heat exchanger and the inlet of said subcooler are placed at substantially the same height with respect to said axis.

15. The air-cooled module according to claim 13, wherein the inlet of said desuperheater and condenser heat exchanger and the outlet of said subcooler are placed nearer to said fan with respect to the outlet of said desuperheater and condenser heat exchanger and the inlet of said subcooler.

16. Air-cooled refrigeration cycle apparatus comprising a compressor means configured to increase the pressure of a refrigerant fluid between an inlet and an outlet of said compressor means, expansion means configured to decrease the pressure of said refrigerant fluid between an inlet and an outlet of said expansion means and an evaporator configured to allow the passage of phase from liquid to gaseous state of said refrigerant fluid between an inlet and an outlet of said evaporator, said air-cooled refrigeration cycle apparatus comprising an air-cooled module according to claim 10 fluidly interposed in series between said compressor means and said expansion means.

17. Air-cooled refrigeration cycle apparatus according to claim 16, further comprising an economizer fluidly interposed in parallel to said air-cooled module between said compressor means and said expansion means.

18. Air-cooled module according to claim 10, wherein said subcooler is a heat exchanger which is not provided with fins.

19. Air-cooled module according to claim 10, wherein said subcooler is a heat exchanger which is provided with fins having a lower density than said desuperheater and condenser heat exchanger.

20. Air-cooled module according to claim 10, wherein said subcooler is provided with tubes having a cross section lower with respect to tubes of which said desuperheater and condenser heat exchanger is provided.

* * * * *